United States Patent [19]

Van Lieshout

[11] 4,221,989

[45] Sep. 9, 1980

[54] ELECTRIC LAMP SEAL CONSTRUCTION

[75] Inventor: Johannes M. J. Van Lieshout, Eindhoven, Netherlands

[73] Assignee: U.S. Philips Corporation, New York, N.Y.

[21] Appl. No.: 21,862

[22] Filed: Mar. 19, 1979

[30] Foreign Application Priority Data

Apr. 20, 1978 [NL] Netherlands ..... 7804198

[51] Int. Cl.[2] ..... H01J 5/50

[52] U.S. Cl. ..... 313/331; 313/315

[58] Field of Search ..... 313/315, 331

[56] References Cited

U.S. PATENT DOCUMENTS

| | | | |
|---|---|---|---|
| 1,791,275 | 2/1931 | Jones | 313/331 X |
| 3,798,491 | 3/1974 | Malm | 313/315 |
| 4,074,167 | 2/1978 | van den Broek et al. | 313/331 X |

*Primary Examiner*—Alfred E. Smith
*Assistant Examiner*—Charles F. Roberts
*Attorney, Agent, or Firm*—Robert S. Smith

[57] ABSTRACT

In electric lamps according to the invention the alkali-alumino-borosilicate glass of the pinch seal of the lamp envelope is directly fused to the molybdenum current supply wire of diameter D. A vacuum-tight seal is obtained in that the glass inside the lamp envelope extends over the current supply wire in a layer which is thinner than D/2 at least over a length of D/2. For use in both incandescent and discharge lamps.

1 Claim, 4 Drawing Figures

ELECTRIC LAMP SEAL CONSTRUCTION

Figure 1:
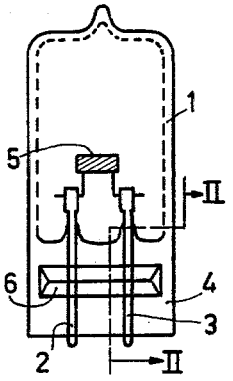

An electric lamp having an envelope at least one portion of which is generally tubular, said portion being sealed in a vacuum-tight manner by a pinch seal around at least one molybdenum current supply wire, having a diameter D, which extends from outside the lamp envelope to an electric element accommodated in the lamp envelope, which portion of the lamp envelope consists of an alkali alumino-borosilicate glass having a coefficient of thermal expansion between 31 and $37\times10^{-7}$°C.$^{-1}$ at 0°-300° C. Such a lamp is known from U.K Patent No. 1,504,228.

In order to obtain a vacuum-tight metal-to-glass seal, a metal and a glass should be used which are compatible, that is to say whose coefficients of thermal expansion are substantially equal over a wide temperature range. If it is necessary to use materials which are not compatible, special measures have to be taken to prevent the seal from losing its vacuum-tightness, for example by cracking. These measures may consist in that the metal is given a special shape as is the case with the very thin molybdenum foils having feathered edges which are used in combination with quartz glass. The manufacture of lamps having such a complicated seal, however, is further complicated due to the extra welded joints which have to be made.

In the lamps according to the above-mentioned Patent Specification the measure of sealing molybdenum wire (coefficient of thermal expansion $54\times10^{-7}$°C.$^{-1}$) in a vacuum-tight manner in glass having a considerably differing coefficient of thermal expansion ($31-37\times10^{-7}$°C.$^{-1}$) consists in that the molybdenum wire is first coated with a thin layer of that type of glass and that a pinch seal is then produced on the coated part of the molybdenum wire. Due to this construction it is achieved that the tensile stesses which arise at the area of the seal both on the inside and on the outside of the lamp envelope at the interface glass-gas are so low that no cracking occurs and vacuum-tightness is ensured.

Although these lamps are simpler to manufacture than lamps in which molybdenum foils are used, the manufacture of the pinch seal of the lamp envelope requires a large part of the production time. This is caused by the step in which the molybdenum wire is coated with glass by sliding a narrow glass tube on it and fusing it to the wire or by providing an enamel on it.

It is the object of the invention to provide electric lamps having a simple lead-through construction of a molybdenum current supply wire through a lamp envelope of a hard glass which can withstand halogen and has a low coefficient of thermal expansion so that it can withstand sudden temperature fluctuations.

This object is achieved in a lamp of the kind mentioned in the preamble which is characterized in that the glass of the pinch seal of the said portion of the lamp envelope is directly fused to the current supply wire and extends inwardly of the lamp envelope circumferentially around the current supply wire in a layer which is thinner than D/2 over a length of at least D/2.

Although on the basis of the large differences in coefficients of thermal expansion between the glass and the molybdenum of the current supply wire large stresses in the seal must be expected which would normally result in loss of the vacuum-tightness as a result of cracking, it has surprisingly been found that a molybdenum wire can be pinched directly in the glass, provided a configuration is obtained in which the glass in the lamp envelope has flowed over the wire in a layer of sufficient length which is thin as compared with the thickness of the wire. Surprisingly no restrictions need be imposed on the thickness of the molybdenum wire which are of importance in practice for supply wires to a filament or to a discharge vessel of a high-pressure discharge lamp, for example, a high-pressure mercury discharge lamp or a high-pressure sodium discharge lamp. For example, good seals could be obtained with molybdenum wires having diameters up to 1 mm and more.

The invention is of particular importance for lamps in which the molybdenum current supply wire must be comparatively thick, i.e. must have a diameter of 400 μm or more, so as to have a sufficient rigidity or to have a sufficiently low current density when current passes through it. The rigidity of the current supply wires is of importance for the maintenance of the position of the electric element inside the lamp envelope when the lamp is subjected to vibrations. A low current density is of importance to prevent losses and too high a pinch temperature.

Although cracks do occur in the pinch seal in the lamps according to the invention, these do not result in leakage of the lamp envelope. On the outside of the lamp envelope where the supply wire emanates from the pinch, very high stresses exist as is to be expected, which give rise to the cracking. It has surprisingly been found, however, that each crack extends from the region where the molybdenum wire emanates from the pinch on the outside of the lamp at a large angle with said wire in the pinch and terminates before the side faces of the pinch have been reached. In cross-sections through the pinch which are situated nearer to the light source, however, the pinch seal is unaffected by cracking and is entirely intact and vacuum-tight.

The kind of glass used, which mainly consists of 77-81% by weight of $SiO_2$; 12-15% by weight of $B_2O_3$; 3-5.5% by weight of $Na_2O$ and 1.5-2.5% by weight of $Al_2O_3$, has a low coefficient of thermal expansion of $31-37\times10^{-7}$°C.$^{-1}$ not only in the temperature range of 0°-300° C. but also up to 500° C. The glass has a good resistance to halogen. It may be used for the manufacture of pressed glass lamps which can safely be splashed with water during operation.

The lead-through construction in a lamp according to the invention may be used in double-pinch incandescent lamps, for example halogen incandescent lamps, and in single pinch incandescent lamps in which several spaced molybdenum current supply wires are situated. However, the construction may also be used in pressed glass lamps. These usually have a mirrored bowl part of the lamp envelope adjoined by a cover glass which may or may not be profiled. In these lamps, prior to the time of the application, ferrules have had to be driven in the glass on which current conductors to the light source had to be connected on the inside and contact means for connection to a lamp holder had to be connected on the outside. The driving-in of ferrules, however, is a critical operation which may give rise to a high reject percentage. The invention permits sealing a tubular piece of hard glass to the bowl part of the lamp envelope which at its free end is sealed with a pinch around the molybdenum current supply wire.

It is to be noted that U.S. Pat. No. 3,798,491 discloses an incandescent lamp in which the glass of a pinch seal is also in direct contact with the current supply wires.

However, in this case it is an alkaline earth alumino-silicate glass having a comparatively low content of silicon dioxide and hence a comparatively high coefficient of thermal expansion. That Patent states that the differences in coefficients of thermal expansion between the glass ($36\text{–}40\times10^{-7}$°C.$^{-1}$) and the wires—tungsten ($46\times10^{-7}$) or molybdenum ($54\times10^{-7}$)—, are so large even for tungsten that the direct sealing of the lamp envelope on the wires is a critical process. It describes how, upon making the pinch seal, an exhaust duct can be kept open therein, but does not state how the sealing of the current supply wires is to be performed so as to obtain a permanent vacuum-tight seal.

The pitch of the present invention resides in the geometry of the innermost part of the pinch seal and the recognition of the fact that, although the outermost part of the pinch seal cannot be obtained in a reproducible manner so as to be free from tensile stresses, the cracks which are the result of said stresses do not break the seal. In the case of an incorrect geometry of the innermost part of the pinch seal on the contrary a leaking lamp would be the result.

It is the more remarkable that with the kind of glass used in lamps according to the invention, good lamps are obtained because said glass also has the same low coefficient of thermal expansion up to 500° C. as it has from 0°–300° C. so that the build-up of stress in the pinch begins already at high temperatures, and thus the final stress at room-temperature is higher than in the case of a glass having a higher coefficient of thermal expansion within the range of 300°–500° C.

The lamp according to the invention can be manufactured in a surprisingly simple manner. For manufacturing a pinch seal in a lamp according to the invention, a degassed molybdenum wire is inserted into a glass tube after which the end of the tube through which the wire enters is heated up to the softening temperature of the glass while a protective gas is fed through the tube in the direction towards the end to be sealed. This may be a non-oxidising gas, for example nitrogen or argon. The velocity of the gas can be controlled so that air can penetrate into the tube against the gas flow over a small distance and oxidise the wire. It has proved advantageous to adjust the velocity of the gas flow so that the wire is oxidised over a part of its sealed length—for example half its length, that is, as a rule, at least 3 mm—and is metallically bright over its remaining part situated closer to the inside of the lamp envelope. The oxidation, which in the case of molybdenum has a brown coloration, has a favourable influence on the adhesion of the glass to the wire. The parts situated inside the lamp envelope, however, will be saved from oxidation. The desired gas velocity can be simply found for any type of lamp by a small series of tests.

During the pinching operation, the softened glass is initially pressed around the wire by means of pinching blocks, after which the heating is continued so as to enable the glass to flow around the wire. The glass of the pinch seal is then blown generally in the axial direction of the tube by means of the protective gas, while the pinch seal is given its final outer shape by pinching blocks. If desired, ribs or grooves may be provided at on the pinch surface.

An alternative possibility of manufacturing a lamp according to the invention consists in that, after providing the softened glass around the current supply wire by means of pinching blocks, heating is continued and the current supply wire is forced deeper in the tube. The pinch seal may then be given its final outer shape by means of pinching blocks.

Upon cooling the pinch seal, the transformation range of the glass is slowly passed, for example at a rate of 10° C. per minute. In the glasses used said range generally lies between 510° and 550° C.

Figure 3:
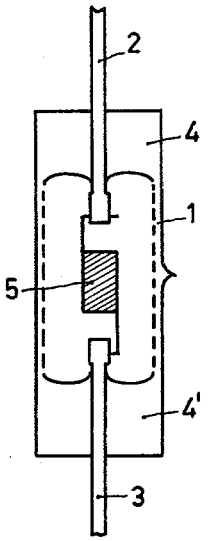
Figure 4:
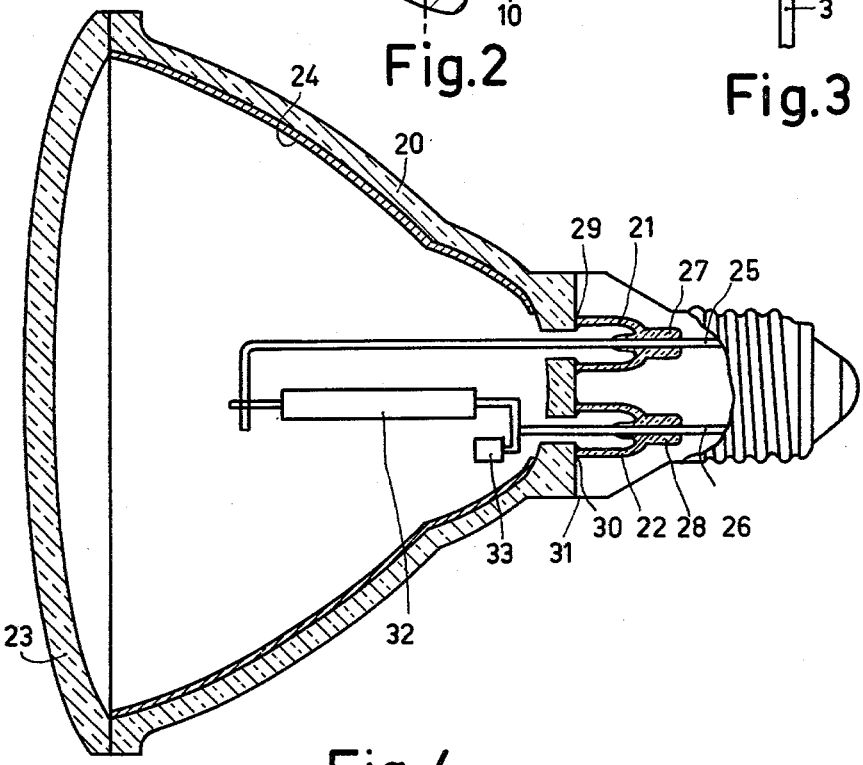

Embodiments of lamps according to the invention will now be described with reference to the accompanying drawing. In the drawing FIG. 1 is an elevation of a single-pinch incandescent lamp, FIG. 2 is a sectional view of the lamp shown in FIG. 1 taken on the line II—II, FIG. 3 is an elevation of a double-pinch incandescent lamp, and FIG. 4 shows a reflector lamp, partly on a longitudinal sectional view, partly in elevation.

In FIG. 1 a lamp envelope 1, of alkaline metal alumino-borosilicate glass of the following composition: 80.5% by weight of $SiO_2$, 13% by weight of $B_2O_3$, 3.5% by weight of $Na_2O$, 2.3% by weight of $Al_2O_3$ and 0.7% by weight of $K_2O$, is sealed directly around molybdenum current supply conductors 2 and 3, each of 400 μm diameter, by means of a pinch seal 4. The ends of the current supply conductors situated inside the lamp envelope are crimped around the limbs of filament 5. In the surface of the pinch a groove 6 is formed in which a fixing member may be inserted upon placing the lamp in a lamp holder. The lamp envelope is filled with krypton, at a pressure of 7 bars, to which 0.1% by volume of $CH_2Br_2$ had been added.

Figure 2:
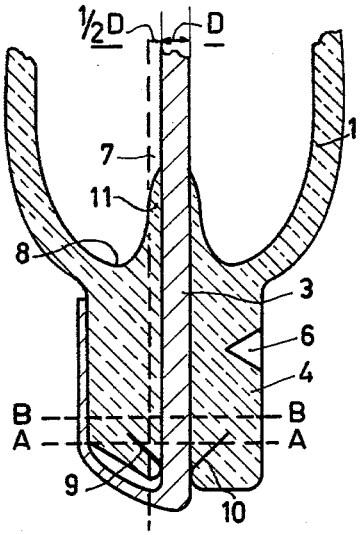

FIG. 2 shows the pinch seal of FIG. 1 in greater detail. Corresponding parts in FIGS. 1, 2 and 3 are referred to by the same reference numerals.

A broken line 7 is shown extending parallel to the part of the current supply conductor 3 situated inside the lamp envelope 1 and the pinch seal 4 at a distance of D/2 from the surface thereof, where D is the diameter of conductor 3.

From the point where the inner surface 8 of the glass of the pinch seal 4 intersects the broken line 7, the layer 11 of glass extending over the current supply conductor 3 is thinner than D/2. The thin layer 11 extends over the current supply conductor 3 from said point over a distance exceeding D/2.

Cracks in the glass of the pinch seal, denoted by 9 and 10, start near the face of the pinch seal 4 from which the wire 3 emanates. They extend from a region of high tensile stresses where the glass of the pinch seal loses its contact with the supply conductors and terminate in a region with pressure stresses situated in the pinch seal. Thus the pinch seal is not vacuum-tight in the section taken along the line A—A but is vacuum-tight in the section taken along the line B—B and sections farther remote from A—A.

In this embodiment the portion of the current supply wire 3 which extends beyond the lamp envelope, is flattened so as to improve the contact with the lamp holder contact.

FIG. 3 shows a double-pinch embodiment having pinch seals 4 and 4' the glass of which is in direct contact with the current supply conductors 2 and 3, respectively, a thin envelope of the glass of the pinched seals extending inwardly of the lamp envelope along the conductors in the manner shown in FIG. 2.

The lamps shown in FIG. 4 has an envelope comprising a paraboloidal bowl part 20 provided with tubular glass extensions 21 and 22 and a sealed cover glass 23.

The part 20 is coated internally with a light-reflective layer 24 for example of aluminium.

Molybdenum current supply conductors 25 and 26 of 700 μm diameter pass through the tubular parts 21 and 22, respectively (inside diameter 6 mm, wall thickness 1 mm) into the bowl of the part 20 of the lamp envelope. The pinch seals 27 and 28 surround the wires in a vacuum-tight manner. The tubular parts 21 and 22 of the lamp envelope are sealed to the bowl part of the lamp envelope at 29 and 30. The lamp vessel has a lamp cap 31 to which the current supply conductors 25 and 26 are connected so as to be insulated from each other. Accommodated in the lamp envelope are a high-pressure sodium vapour discharge tube 32 and a getter 23. The glass of the pinched seals extends along the conductors 25 and 26 inwardly of the lamp in the manner described with reference to FIG. 2.

What is claimed is:

1. An electric lamp having an envelope at least one portion of which is generally tubular, said portion being sealed in a vacuum-tight manner by a pinch seal around at least one molybdenum current supply wire, having a diameter D, which extends from outside the lamp envelope to an electric element accommodated in the lamp envelope, which portion of the lamp envelope consists of an alkali-alumino-borosilicate glass having a coefficient of thermal expansion between 31 and $37\times10^{-7}$°C.$^{-1}$ at 0°-300° C., characterized in that the glass of the pinch seal of the generally tubular of the lamp envelope is directly fused to the current supply wire and extends inwardly of the lamp envelope circumferentially around the current supply wire in a layer which is thinner than D/2 over a length of at least D/2.

* * * * *